US008853538B2

(12) United States Patent
Yamada

(10) Patent No.: US 8,853,538 B2
(45) Date of Patent: Oct. 7, 2014

(54) CABLE CONNECTION STRUCTURE AND CABLE CONNECTION BOARD

(75) Inventor: Junya Yamada, Kawasaki (JP)

(73) Assignee: Olympus Corporation, Tokyo (JP)

( * ) Notice: Subject to any disclaimer, the term of this patent is extended or adjusted under 35 U.S.C. 154(b) by 256 days.

(21) Appl. No.: 13/423,437

(22) Filed: Mar. 19, 2012

(65) Prior Publication Data

US 2012/0292104 A1 Nov. 22, 2012

(30) Foreign Application Priority Data

May 17, 2011 (JP) ..... 2011-110651

(51) Int. Cl.
*H01R 4/02* (2006.01)
*H01R 12/59* (2011.01)
*H01R 43/02* (2006.01)

(52) U.S. Cl.
CPC ..... *H01R 12/598* (2013.01); *H01R 43/0256* (2013.01)
USPC .... 174/84 R; 174/74 R; 174/88 R; 174/88 C; 174/94 R; 439/874

(58) Field of Classification Search
CPC ..... H01R 4/00; H01R 4/10; H01R 9/0518; H01R 9/05
USPC ..... 439/874–880, 296, 329; 174/84 R, 88 R, 174/70 R, 71 R, 85–87, 88 C, 88 S, 89, 94 R, 174/84 C, 68.1, 260, 255, 251, 261, 113, 174/250, 74 R
See application file for complete search history.

(56) References Cited

U.S. PATENT DOCUMENTS

| | | | | |
|---|---|---|---|---|
| 3,743,748 | A * | 7/1973 | Reeder | 174/75 C |
| 5,347,711 | A * | 9/1994 | Wheatcraft et al. | 29/843 |
| 5,710,393 | A * | 1/1998 | Smith et al. | 174/74 R |
| 6,336,827 | B1 * | 1/2002 | Akama et al. | 439/607.46 |
| 6,823,587 | B2 * | 11/2004 | Reed | 29/858 |
| 7,696,436 | B2 * | 4/2010 | Tanaka | 174/74 R |

FOREIGN PATENT DOCUMENTS

| | | |
|---|---|---|
| JP | H04-197334 | 7/1992 |
| JP | 2006-014906 | 1/2006 |

* cited by examiner

*Primary Examiner* — Angel R Estrada
*Assistant Examiner* — Dimary Lopez Cruz
(74) *Attorney, Agent, or Firm* — Scully, Scott, Murphy & Presser, P.C.

(57) ABSTRACT

A cable connection structure according to the present invention includes a board and a cable to be connected to the board via a connecting electrode, the board includes at least two protruding parts constituting a groove part in which a conducting body of the cable is arranged on the connecting electrode, the protruding parts include a fixed protruding part which does not fuse in soldering the conducting body onto the connecting electrode, and an extending direction of the conducting body arranged in the groove part is not aligned with an extending direction of the cable.

11 Claims, 9 Drawing Sheets

CABLE CONNECTION STRUCTURE AND CABLE CONNECTION BOARD

CROSS-REFERENCE TO RELATED APPLICATION

This application is based upon and claims the benefit of priority from Japanese Patent Application No. 2011-110651, filed on May 17, 2011, the entire contents of which are incorporated herein by reference.

BACKGROUND OF THE INVENTION

1. Field of the Invention

The present invention relates to a cable connection structure in which a cable is connected to a board, and a cable connection board.

2. Description of the Related Art

Conventionally, a medical endoscope enables an observation of a lesion site when an insertion unit is deeply inserted to an inside of a body and further enables an examination and a medical treatment in the inside of the body by using a treatment tool together depending on a necessity. As such an endoscope, there is an endoscope provided with an imaging device in which an imaging element such as a CCD is embedded at a distal end of the insertion unit. The endoscope is configured by embedding an imaging module on which an imaging device is mounted in the distal end part of the elongated insertion unit having flexibility and enables an observation and the like of a test site when the insertion unit is inserted in an inside of a body cavity. The distal end part of the insertion unit has been desired to be thinner, shorter, and smaller to ease a pain of a patient.

As a technique for solving the problem, a technique for challenging an improvement in density of signal cables by folding a flexible board connected to an imaging device in half and the like are disclosed in Japanese Patent Application Laid-Open No. H04-197334, for example.

Besides, an electronic endoscope provided with a signal wire fixation groove which fixes a signal wire of a cable on a circuit board in the vicinity of a signal wire connection terminal part is disclosed in Japanese Patent Application Laid-Open No. 2006-14906, for example.

However, it is only possible in the technique disclosed in Japanese Patent Application Laid-Open No. H04-197334 to connect core wires at the same alignment pitch as signal cables on the flexible board. The alignment pitch of cables is generally a pitch aligned by a jig or a pitch aligned at a state where cables are in contact with each other by their outer coverings, and cables are fixed at the aligned state by a lamination and the like, for example. On this occasion, it is at least impossible to connect core wires at a pitch not more than the outermost diameter of the cable. Therefore, there is a restriction of a layout in mounting on a board.

Besides, it is only possible in the technique disclosed in Japanese Patent Application Laid-Open No. 2006-14906 to connect cables at a pitch aligned by their outer covering parts while there is an advantage of being able to prevent a misalignment of signal wires. Moreover, it is difficult to make a dimension small since a circuit board is connected to an imaging device via a wire lead and the like.

SUMMARY OF THE INVENTION

According to an aspect of the present invention, in a cable connection structure in which a cable and a board provided with a connecting electrode to which the cable is connected are connected, the board includes at least two protruding parts constituting a groove part in which a conducting body of the cable is arranged on the connecting electrode, the protruding parts include a fixed protruding part which does not fuse in soldering the conducting body onto the connecting electrode, and an extending direction of the conducting body arranged in the groove part is not aligned with an extending direction of the cable.

The above and other features, advantages, and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a cable connection structure according to the present invention will be explained below with reference to the accompanying drawings. It should be noted that the present invention is not limited to the embodiments. The same part is assigned with the same reference symbol in the description of the drawings.

Figure 1:
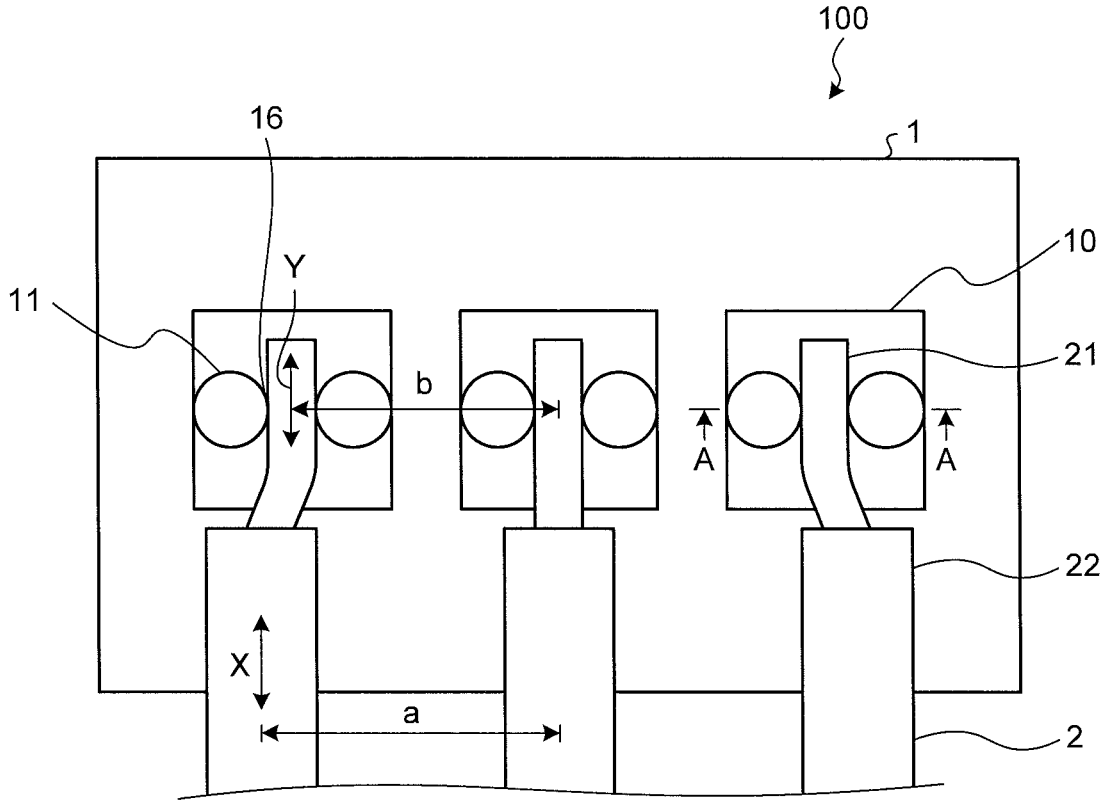
FIG. 1 schematically shows a cable connection structure according to a first embodiment.
Figure 2:
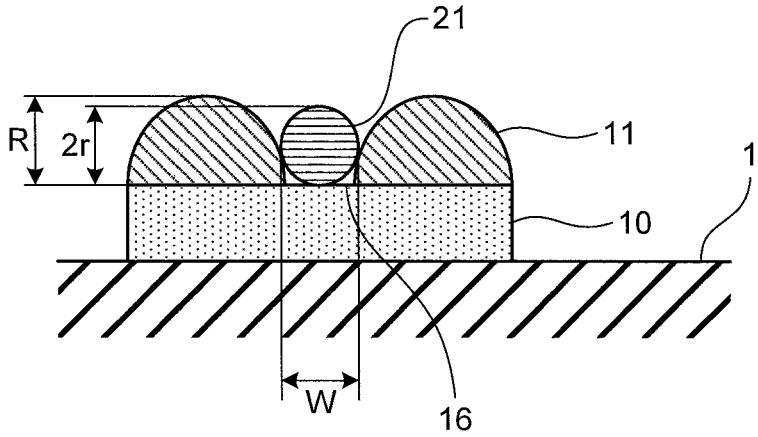
FIG. 2 is a cross-sectional view along a line A-A in the cable connection structure in FIG. 1.

FIG. 1 schematically shows a cable connection structure 100 according to a first embodiment. FIG. 2 is a cross-sectional view along a line A-A in the cable connection structure 100 in FIG. 1. The cable connection structure 100 according to the first embodiment is provided with a board 1 and a cable 2 connected to the board 1 as shown in FIG. 1.

The cable 2 is provided with a conducting body 21 as a core wire and an outer covering 22 as an insulating body provided in an outer circumference of the conducting body 21. The board 1 is provided with a connecting electrode 10 to which the conducting body 21 of the cable 2 is connected. While the board 1 shown in FIG. 1 includes three connecting electrodes 10, to which three respective cables 2 are connected, the number of connecting electrodes 10 is not limited thereto as long as the number of connecting electrodes 10 provided corresponds to the number of cables 2 to connect.

On each connecting electrode 10, two hemispherical protruding parts 11 are formed and arranged. As shown in FIG. 2, the conducting body 21 of the cable 2 is arranged in a groove part 16 which is constituted by side surfaces of the two protruding parts 11 and a front surface of the connecting electrode 10. The protruding part 11 is formed by arranging a bump such as a gold bump, a high-melting-point solder bump, or the like on the connecting electrode 10. In the description of the present invention, the high-melting-point solder bump means a bump formed of a solder (a solder of tin-lead system of Sn-90Pb composition, melting point, i.e., solidus temperature of which is 275 degrees C., for example) having a melting point substantially higher than an eutectic solder of tin-lead system, melting point of which is 184 degrees C. or a solder of tin-silver-copper system (of Sn-3.0Ag-0.5Cu composition, melting point of which is as high as 220 degrees C., for example) widely used as a lead-free solder.

In the first embodiment, the groove part 16 is formed so that an extending direction Y of the conducting body 21 arranged in the groove part 16 as shown in FIG. 1 is not aligned with an extending direction X of the cable 2. In an assembled cable in which a plurality of cables 2 are assembled as shown in FIG. 1, it is only necessary for satisfying the gist of the present invention to form the connecting electrode 10 and the protruding parts 11 on the board 1 so that an extending direction Y of the conducting body 21 of at least one cable 2 constituting the assembled cable is not aligned with the extending direction X of the cable 2.

Besides, the connecting electrode 10 and the protruding parts 11 are formed so that an alignment pitch b of the conducting bodies 21 becomes narrower than an alignment pitch a of the cables 2 in the first embodiment. By folding and arranging in the groove part 16 the conducting part 21 of the cable 2 on the board 1 formed in this manner, providing a joint member such as a solder to a joint part between the conducting part 21 and the connecting electrode 10, and heating, by a heating tool and the like, the joint member to cause fusion for connection, the alignment pitch b of the conducting bodies 21 is made narrower than the alignment pitch a of the cables 2.

It is preferable that a height R of the protruding part 11 is more than a diameter 2*r* of the conducting body 21 of the cable 2 in the first embodiment. By making the height R of the protruding part 11 more than the diameter 2*r* of the conducting body 21, the fixation of the conducting body 21 can be performed easily. In jointing the conducting body 21 and the connecting electrode 10 by heating the joint member such as a solder to cause fusion by a heating tool and the like, for example, the height R of the protruding part 11 more than the diameter 2*r* of the conducting body 21 stops a decent of the heating tool due to a contact with the protruding part 11 and allows starting heating at the height of the protruding part 11. Therefore, it is possible to prevent the conducting body 21 from being subjected to a load and getting crushed and to suppress an occurrence of a connection failure by making the height R of the protruding part 11 more than the diameter 2*r* of the conducting body 21.

It is preferable that a width W of the groove part 16 formed by at least two protruding parts 11 is equal to or less than the diameter 2*r* of the conducting part 21 from a standpoint of preventing a misalignment in position of the conducting body 21. The width W of the groove part 16 means a distance between two points where the conducting part 21 are in contact with the protruding parts 11 constituting the groove part 16 in the description of the present invention. Here, though the conducting part 21 comes to a state of not being in direct contact with the contacting electrode 10 when the width W is made shorter, the conducting part 21 can have an electrical continuity with the connecting electrode 10 via the protruding parts 11 even in this case. However, to joint the conducting body 21 to the connecting electrode 10 more securely, it is more preferable that the conducting part 21 is in direct contact with the connecting electrode 10.

In the cable connection structure 100 according to the first embodiment, a degree of freedom of the layout in mounting the conducting body 21 onto the board 1 can be improved by making a connection to the board 1 so that the extending direction Y of the conducting body 21 of the cable 2 is not aligned with the extending direction X of the cable 2 in the manner described above. Besides, by making the alignment pitch b of the conducting bodies 21 narrower than the alignment pitch a of the cables 2, the board 1 and the cable connection structure 100 can be made small without making the conducting part 21 thinner. Thus, it becomes possible to stably connect a lot of cables in a small area, which is suitable for a configuration of an endoscope and an ultrasound image system (ultrasound endoscope).

Figure 3:
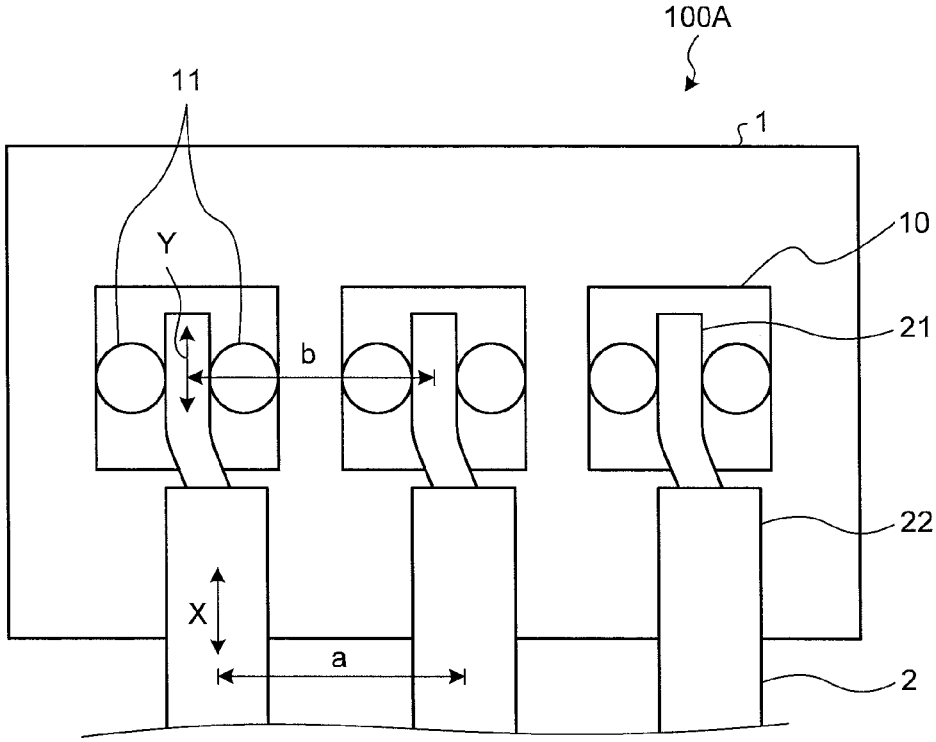
FIG. 3 schematically shows a cable connection structure according to a first modification of the first embodiment.

As a first modification of the first embodiment of the present invention, a cable connection structure 100A shown in FIG. 3 is exemplified. In the cable connection structure 100A according to the first modification, the connecting electrode 10 and the protruding parts 11 are formed so that the extending direction Y of the conducting body 21 is not aligned with the extending direction X of the cable 2. In the first modification, the alignment pitch b of the conducting bodies 21 is the same as the alignment pitch a of the cables 2 since a bending direction of the conducting bodies 21 is the same. In the cable connection structure 100A having such a structure as described according to the first modification, a degree of freedom of the layout in mounting the conducting body 21 onto the board 1 can be improved similarly to the cable connection structure 100 according to the first embodiment.

Besides, as a second modification of the first embodiment of the present invention, a cable connection structure in which the alignment pitch b of the conducting bodies 21 is wider than the alignment pitch a of the cables 2 is exemplified. By making the pitch b of the conducting bodies 21 wider than the alignment pitch a of the cables 2, adverse effects including crosstalk noise caused by an interference between signals transmitted in respective cables can be suppressed.

Figure 4:
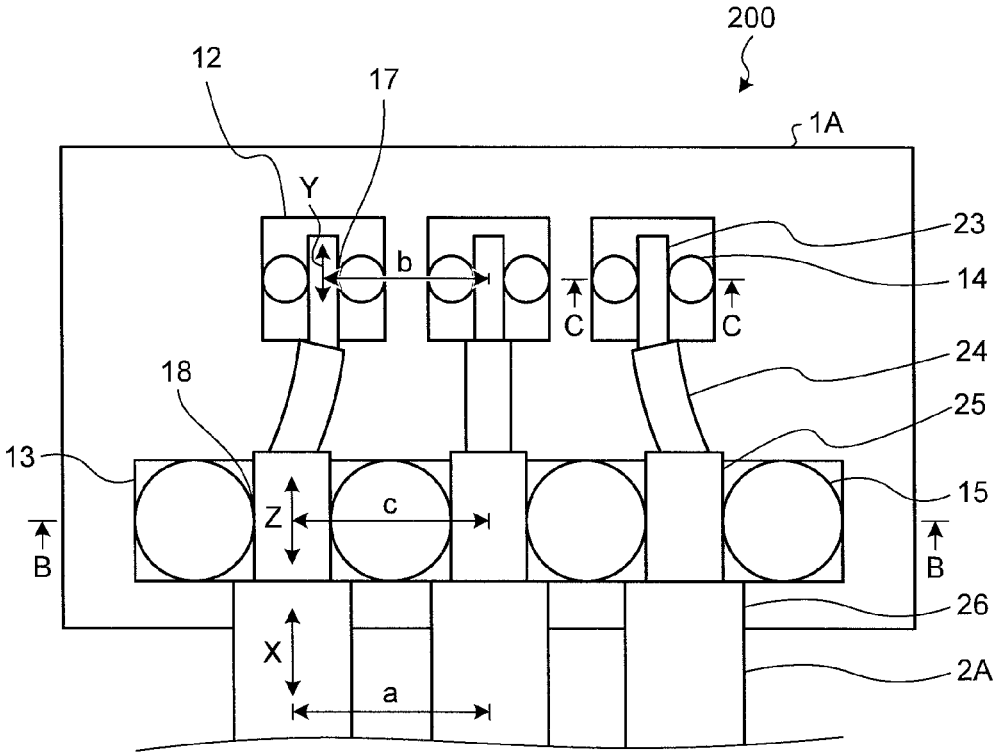
FIG. 4 schematically shows a cable connection structure according to a second embodiment.
Figure 5:
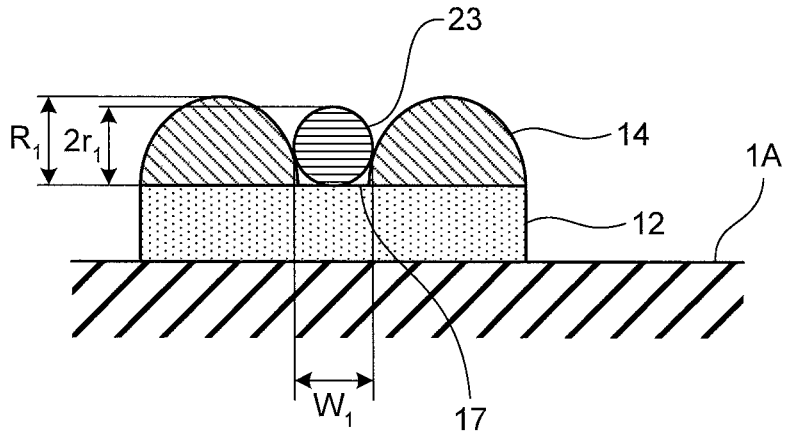
FIG. 5 is a cross-sectional view along a line C-C in the cable connection structure in FIG. 4.
Figure 6:
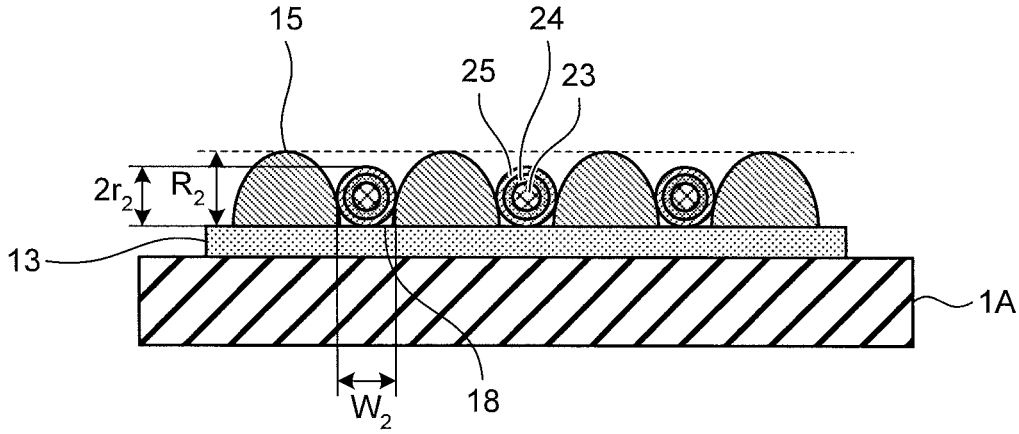
FIG. 6 is an enlarged cross-sectional view along a line B-B in the cable connection structure in FIG. 4.

Next, a second embodiment of the present invention will be explained. FIG. 4 schematically shows a cable connection structure 200 according to a second embodiment. FIG. 5 is a cross-sectional view along a line C-C in the cable connection structure 200 in FIG. 4. FIG. 6 is an enlarged cross-sectional view along a line B-B in the cable connection structure 200 in FIG. 4. The cable connection structure 200 according to the second embodiment is provided with a board 1A and a coaxial cable 2A connected to the board.

The coaxial cable 2A is provided with a center conducting body 23 as a core wire, an inner insulating body 24 provided in an outer circumference of the center conducting body 23, an outer conducting body 25 as a shielded wire which covers an outer circumference of the inner insulating body 24, and an outer insulating body 26 provided in an outer circumference of the outer conducting body 25.

The board 1A is provided with a center conducting body connecting electrode 12 (a core wire connecting electrode) to which the center conducting body 23 is connected and an outer conducting body connecting electrode 13 (a shielded wire connecting electrode) to which the outer conducting body 25 is connected. On each center conducting body connecting electrode 12, two hemispherical first protruding parts 14 are formed. A first groove part 17 in which the center conducting body 23 to connect is arranged is formed by the hemispherical first protruding parts 14 and the center conducting body connecting electrode 12.

The first protruding part 14 is formed by a gold bump or a high-melting-point solder bump. It is preferable that a height $R_1$ of the first protruding part 14 is more than a diameter $2r_1$ of the center conducting body 23. By making the height $R_1$ of the first protruding part 14 more than the diameter $2r_1$ of the center conducting body 23, a positional regulation of the center conducting body 23 is performed easily. In jointing the center conducting body 23 and the center conducting body connecting electrode 12 by heating a joint member such as a solder to cause fusion by a heating tool, for example, the height $R_1$ of the first protruding part 14 more than the diameter $2r_1$ of the center conducting body 23 allows preventing the center conducting body 23 from being subjected to a load and getting crushed and suppressing an occurrence of a connection failure.

Besides, it is preferable that a width $W_1$ of the first groove part 17 formed by at least two first protruding parts 14 is approximately equal to the diameter $2r_1$ of the center conducting body 23 from a standpoint of preventing a misalignment in position of the center conducting body 23.

On each outer conducting body connecting electrode 13, a hemispherical second protruding part 15 is formed. The second protruding part 15 is formed in line at equally-spaced intervals on the outer conducting body connecting electrode 13, the number of the second protruding part 15 being equivalent to the number obtained by adding one to the number of outer conducting bodies 25 which are connected to the board 1A along a longitudinal direction of the outer conducting body connecting electrode 13. A second groove part 18 is formed by the second protruding parts 15 arranged in line at equally-spaced intervals on the outer conducting body connecting electrode 13 and the outer conducting body connecting electrode 13, the number of the second groove part 18 being equivalent to the number of outer conducting bodies 25 to connect.

The second protruding part 15 is formed by a gold bump or a high-melting-point solder bump. It is preferable that a height $R_2$ of the second protruding part 15 is more than a diameter $2r_2$ of the outer conducting body 25. By making the height $R_2$ of the second protruding part 15 more than the diameter $2r_2$ of the outer conducting body 25, a positional regulation of the outer conducting body 25 is performed easily. In jointing the outer conducting body 25 and the outer conducting body connecting electrode 13 by heating a joint member such as a solder to cause fusion by a heating tool, for example, the height $R_2$ of the second protruding part 15 more than the diameter $2r_2$ of the outer conducting body 25 allows preventing the outer conducting body 25 from being subjected to a load and getting crushed to prevent the inner insulating body 24 from being damaged and suppressing an occurrence of a connection failure.

Besides, it is preferable that a width $W_2$ of the second groove part 18 formed by two second protruding parts 15 is approximately equal to the diameter $2r_2$ of the outer conducting body 25 from a standpoint of preventing a misalignment in position of the outer conducting body 25.

In the second embodiment, the first groove part 17 is formed so that the extending direction Y of the center conducting body 23 arranged in the first groove part 17 as shown in FIG. 4 is not aligned with the extending direction X of the coaxial cable 2A. Here, an extending direction Z of the outer conducting body 25 arranged in the second groove part 18 is aligned with the extending direction X of the coaxial cable 2A. In an assembled cable in which a plurality of coaxial cables 2A shown in FIG. 4 are assembled, it is only necessary to form the center conducting body connecting electrode 12 and the first protruding parts 14 on the board 1A so that the extending direction Y of the center conducting body 23 of at least one coaxial cable 2A constituting the assembled cable is not aligned with the extending direction X of the coaxial cable 2A.

In the second embodiment, the center conducting body connecting electrode 12 and the first protruding parts 14 are formed so that the alignment pitch b of the center conducting bodies 23 is narrower than the alignment pitch a of the coaxial cables 2A. The outer conducting body connecting electrode 13 and the second protruding parts 15 are formed so that an alignment pitch c of the outer conducting bodies 25 becomes the same as the alignment pitch a of the coaxial cables 2A. By arranging the outer conducting body 25 of the coaxial cable 2A in the second groove part 17, arranging, by bending the inner insulating body 24, the center conducting body 23 in the first groove part 17, supplying a joint member such as a solder to a joint part of the conducting part and the connecting electrode, and making a connection via heating the joint member to cause fusion by a heating tool on the board 1A formed in this manner, the alignment pitch b of the center conducting bodies 23 can be made narrower than the alignment pitch a of the coaxial cables 2A.

In the cable connection structure 200 according to the second embodiment, a degree of freedom of the layout in mounting the center conducting body 23 on the board 1A can be improved by making the connection to the board 1A so that the extending direction Y of the center conducting body 23 of the coaxial cable 2A is not aligned with the extending direction X of the coaxial cable 2A in the manner described above. Besides, by making the alignment pitch b of the center conducting bodies 23 narrower than the alignment pitch a of the coaxial cables 2A, a mounting density of the members to be mounted on the board 1A can be improved and the board 1A and the cable connection structure 200 can be made small. Thus, it becomes possible to stably connect a lot of coaxial cables in a small area, which is suitable for a configuration of an endoscope and an ultrasound image system (ultrasound endoscope).

Figure 7:
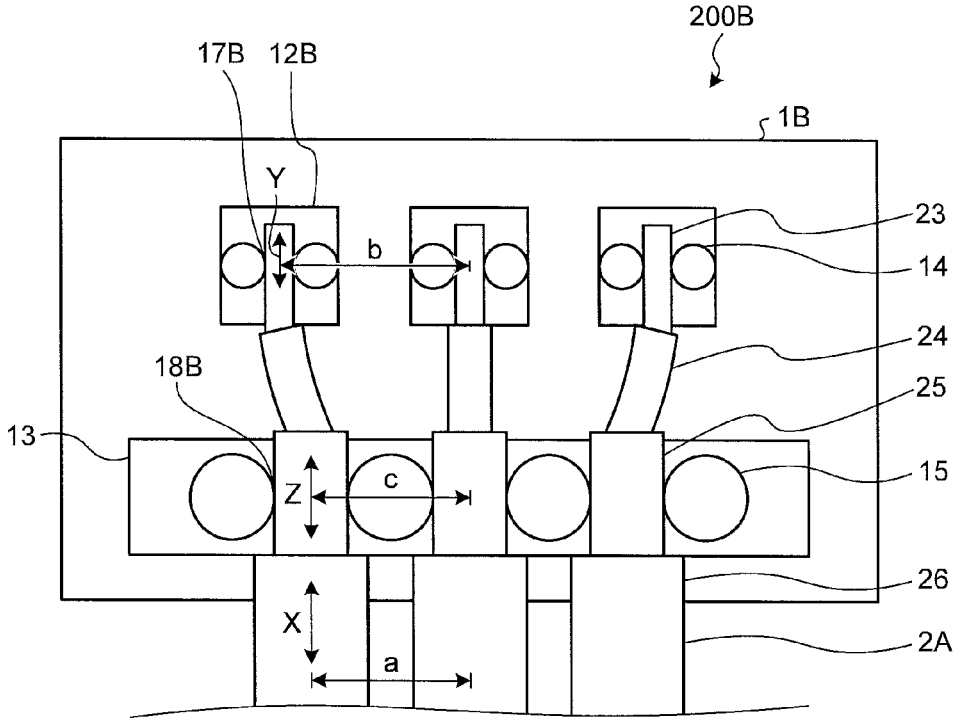
FIG. 7 schematically shows a cable connection structure according to a first modification of the second embodiment.

As a first modification of the second embodiment of the present invention, a cable connection structure 200B shown in FIG. 7 is exemplified. In the cable connection structure 200B according to the first modification, a center conducting body connecting electrode 12B and the first protruding parts 14 are formed so that the extending direction Y of the center conducting body 23 is not aligned with the extending direction X of the coaxial cable 2A and the alignment pitch b of the center conducting bodies 23 becomes wider than the alignment pitch a of the coaxial cables 2A. In the first modification, by making the alignment pitch b of the center conducting bodies 23 wider than the alignment pitch a of the coaxial cables 2A, an adverse effect caused by an interference between signals transmitted in respective cables can be suppressed.

Figure 8:
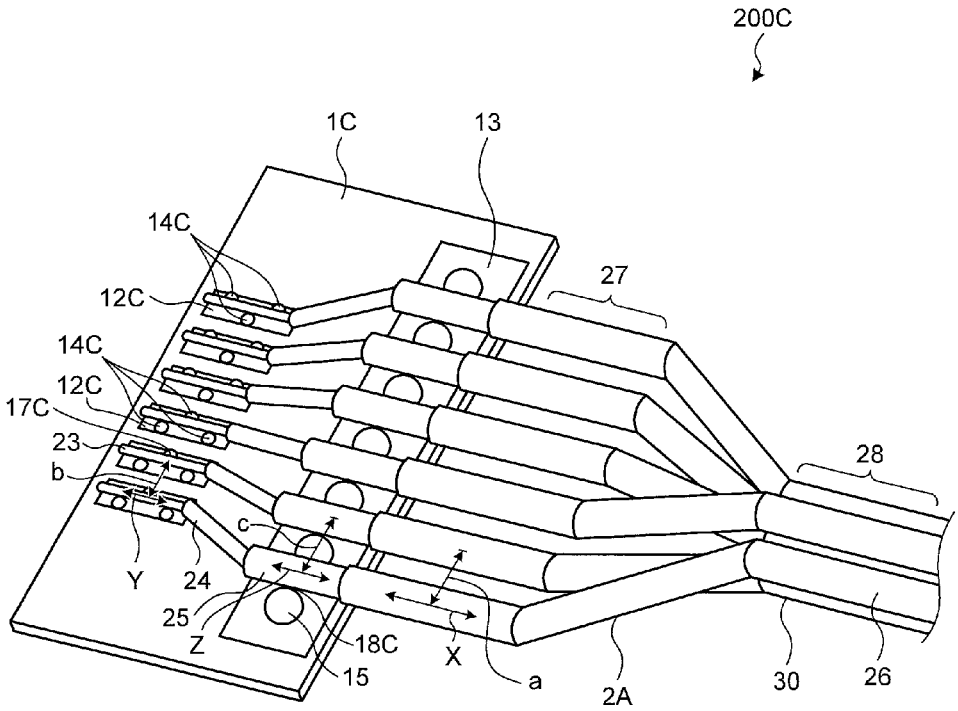
FIG. 8 schematically shows a cable connection structure according to a second modification of the second embodiment.

As a second modification of the second embodiment of the present invention, a cable connection structure 200C shown in FIG. 8 is exemplified. The cable connection structure 200C according to the second modification is provided with an assembled cable 30 and a board 1C to which the assembled cable 30 is connected. The assembled cable 30 is a cable in which a plurality of coaxial cables 2A are bundled and is provided with a cable aligning unit 27 and a cable bundling unit 28. In the second modification, a first groove part 17C is formed so that the extending direction Y of the center conducting body 23 is not aligned with the extending direction X of the coaxial cable 2A and the alignment pitch b of the center conducting bodies 23 becomes narrower than the alignment pitch a of the coaxial cables 2A, similarly to the second embodiment. In the second modification, three first protruding parts 14C are formed in a zigzag manner along a direction in which the center conducting body 23 extends on the center conducting body connecting electrode 12C. While the first protruding parts 14C are formed in a manner that one locates at one side of the left and the right sides and two locates at the other one side of the left and the right sides, it is preferable that two first protruding parts 14C are formed at a side where a more stress is imposed due to a bend of the center conducting body 23. As shown in FIG. 8, the center conducting body 23 of the coaxial cable 2A at a right side seen from the assembled cable 30 is arranged in the first groove part 17C in a manner that the inner insulating body 24 is bent rightward from a direction along which the outer conducting body 25 is aligned. Therefore, it is preferable that two first protruding parts 14C are formed at the left side of the center conducting body 23 since the center conducting body 23 goes back by itself to the left side. In the second modification, by making the alignment pitch b of the center conducting bodies 23 narrower than the alignment pitch a of the coaxial cables 2A, a mounting density on the board 1C can be improved and the board 1C and the cable connection structure 200C can be made small.

Figure 9:
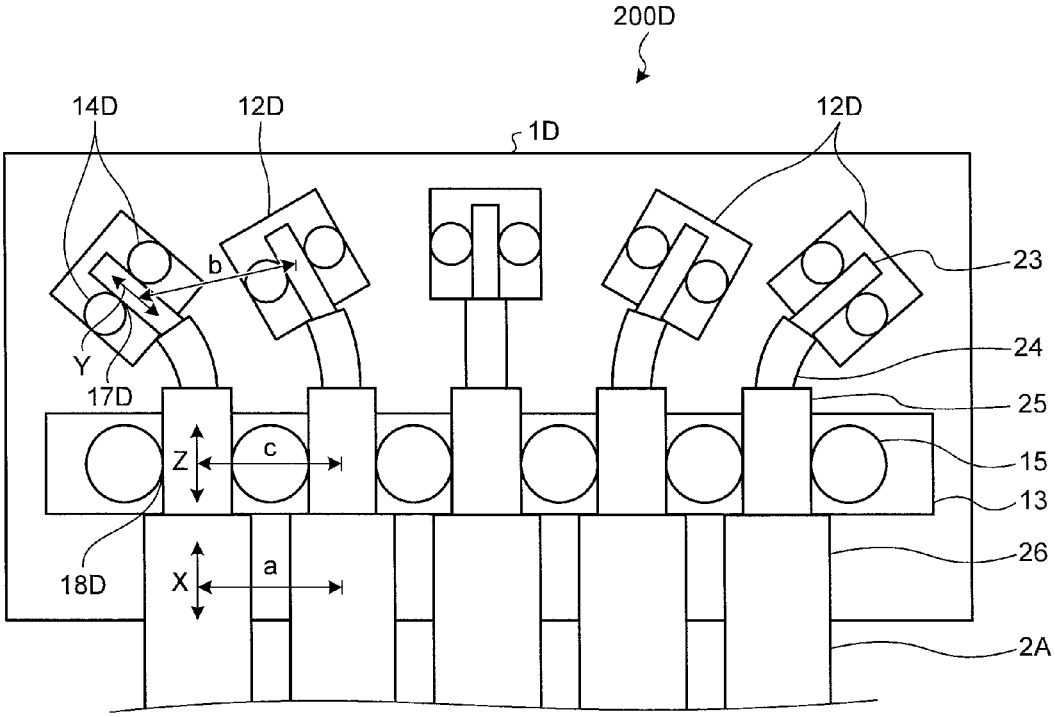
FIG. 9 schematically shows a cable connection structure according to a third modification of the second embodiment.

As a third modification of the second embodiment of the present invention, a cable connection structure 200D shown in FIG. 9 is exemplified. In the cable connection structure 200D according to the third modification, a center conducting body connecting electrode 12D and first protruding parts 14D are formed so that the extending direction Y of the center conducting body 23 is not aligned with the extending direction X of the coaxial cable 2A and the alignment pitch b of the center conducting bodies 23 becomes wider than the alignment pitch a of the coaxial cables 2A, similarly to the first modification. Besides, in the third modification, the center conducting body connecting electrode 12D and the first protruding parts 14D are formed so that a sum of a length of the exposed center conducting body 23, a length of the exposed inner insulating body 24, and a length of the exposed outer conducting body 25 is the same in respective coaxial cables 2A, which is different from the first modification. While each of the center conducting body connecting electrodes 12B is formed in parallel with the outer conducting body connecting electrode 13 and respective extending directions of the center conducting bodies 23 are parallel to each other in the first modification, the center conducting body connecting electrodes 12D are formed in an arc shape as a whole in the third modification. By forming the center conducting body connecting electrodes 12D in this manner, a sum of the length of the exposed center conducting body 23 and the length of the exposed inner insulating body 24 becomes the same in respective coaxial cables 2A. The third modification is advantageous in that an adverse effect caused by an interference between signals transmitted in respective coaxial cables 2A can be suppressed and uniform coaxial cables 2A can be used since the sum of the length of the exposed center conducting body 23, the length of the exposed inner insulating body 24, and the length of the exposed outer conducting body 25 is the same in the respective coaxial cables 2A connected to the board 1D.

Figure 10:
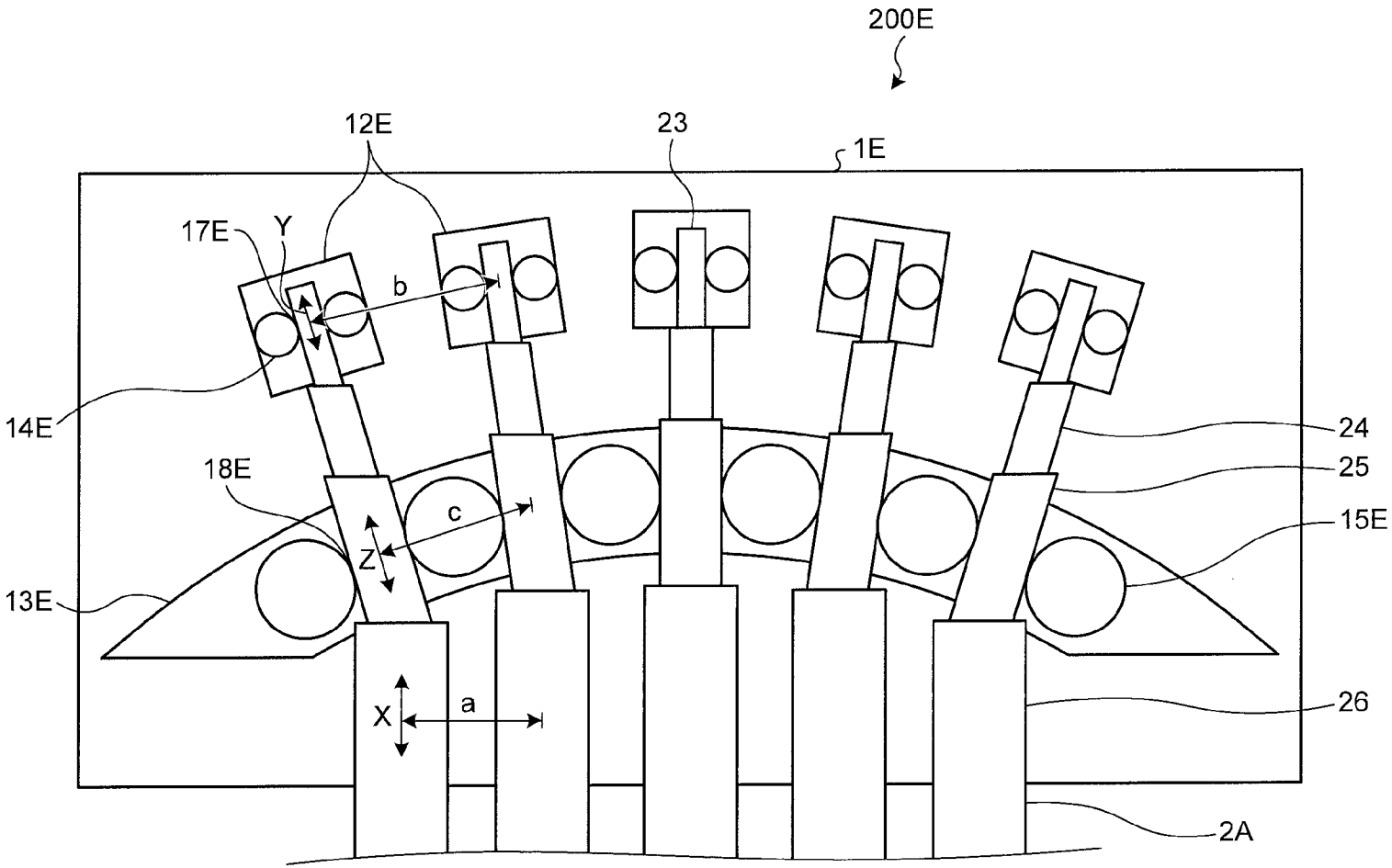
FIG. 10 schematically shows a cable connection structure according to a fourth modification of the second embodiment.

As a fourth modification of the second embodiment of the present invention, a cable connection structure 200E shown in FIG. 10 is exemplified. In the cable connection structure 200E according to the fourth modification, an outer conducting body connecting electrode 13E and second protruding parts 15E are formed so that the extending direction Z of the outer conducting body 25 is not aligned with the extending direction X of the coaxial cable 2A and the alignment pitch c of the outer conducting bodies 25 becomes wider than the alignment pitch a of the coaxial cables 2A. In the fourth modification, the outer conducting body connecting electrodes 13E are formed in an arc shape so that the extending direction Z of the outer conducting body 25 is not aligned with the extending direction X of the coaxial cable 2A. In addition, the center conducting body connecting electrodes 12E are formed in an arc shape so that the extending direction Y of the center conducting body 23 is aligned with the extending direction Z of the outer conducting body 25. In the fourth modification, by forming the center conducting body connecting electrodes 12E and the outer conducting body connecting electrode 13E in the arc shape, the sum of the length of the exposed center conducting body 23, the length of the exposed inner insulating body 24, and the length of the exposed outer conducting body 25 becomes the same in respective coaxial cables 2A. This configuration is advantageous in that uniform coaxial cables 2A can be used. Moreover, an adverse effect caused by an interference between signals transmitted in respective coaxial cables 2A can be suppressed since the alignment pitch c of the outer conducting bodies 25 is wider than the alignment pitch a of the coaxial cables 2A in the fourth modification.

Figure 11:
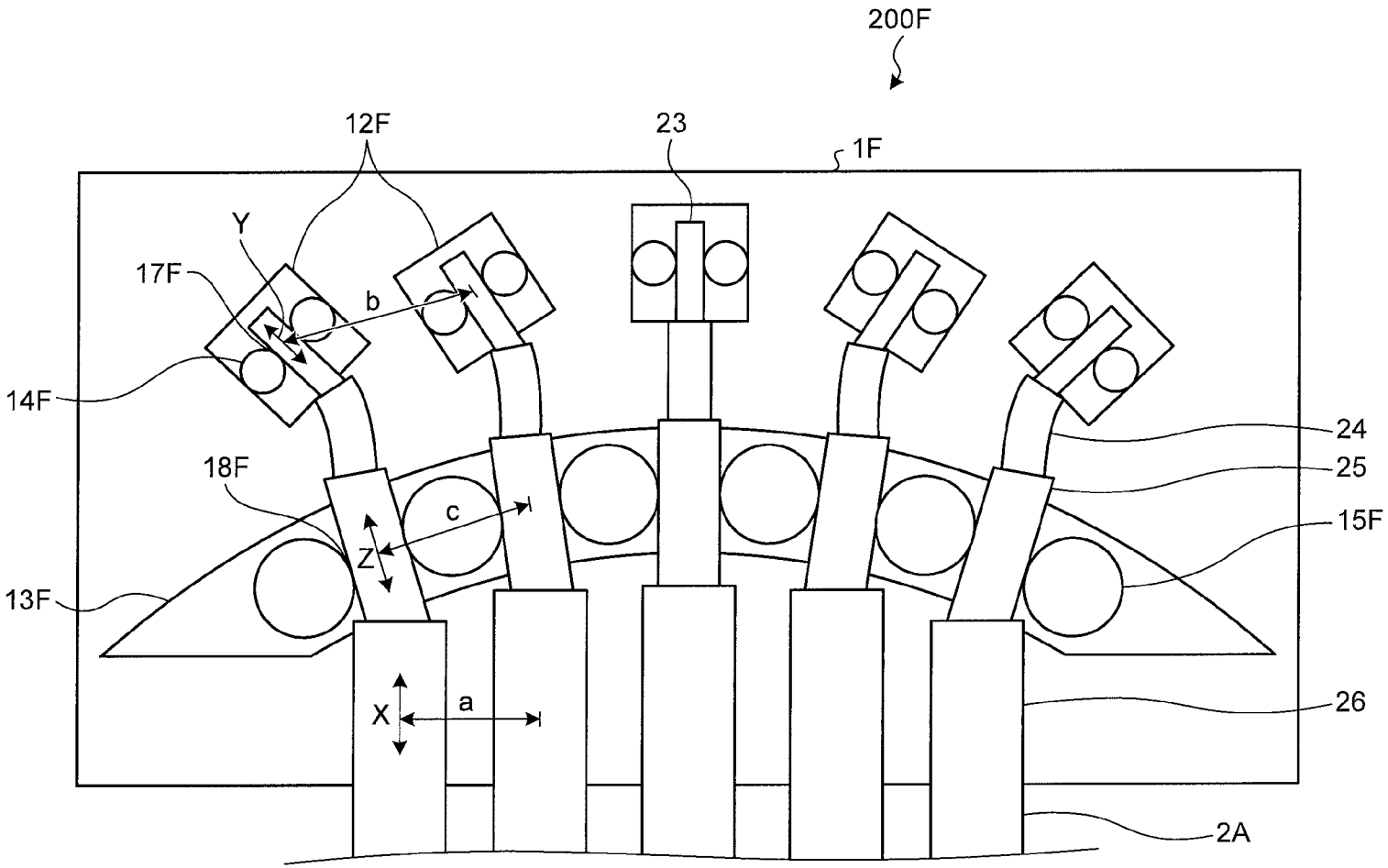
FIG. 11 schematically shows a cable connection structure according to a fifth modification of the second embodiment.

As a fifth modification of the second embodiment of the present invention, a cable connection structure 200F shown in FIG. 11 is exemplified. In the cable connection structure 200F according to the fifth modification, an outer conducting body connecting electrode 13F and second protruding parts 15F are formed so that the extending direction Z of the outer conducting body 25 is not aligned with the extending direction X of the coaxial cable 2A, and a center conducting body connecting electrode 12F and first protruding parts 14F are formed so that the extending direction Y of the center conducting body 23 is not aligned with the extending direction Z of the outer conducting body 25. In the fifth modification, the alignment pitch c of the outer conducting bodies 25 is wider than the alignment pitch a of the coaxial cables 2A and the alignment pitch b of the center conducting bodies 23 is wider than the alignment pitch c of the outer conducting bodies 25. In the cable connection structure 200F according to the fifth modification, the outer conducting body 25 is bent from the alignment direction X of the coaxial cable 2A to the Z direction, arranged in a second groove part 18F, and then connected and the center conducting body 23 is further bent from the extending direction Z of the outer conducting body to the Y direction, arranged in a first groove part 17F, and then connected. In the fifth modification, by forming the center conducting body connecting electrode 12F and the outer conducting body connecting electrode 14F in such a manner as described, the sum of the length of the exposed center conducting body 23, the length of the exposed inner insulating body 24, and the length of the exposed outer conducting body 25 is the same in respective coaxial cables 2A. This configuration is advantageous in that uniform coaxial cables 2A can be used. Moreover, an adverse effect caused by an interference between signals transmitted in respective coaxial cables 2A can be suppressed since the alignment pitch b of the center conducting bodies 23 is wider than the alignment pitch a of the coaxial cables 2A in the fifth modification.

A third embodiment of the present invention will be explained next. In a cable connection structure according to the third embodiment, protruding parts forming a groove part include a fixed protruding part and a fusing protruding part.

Figure 12:
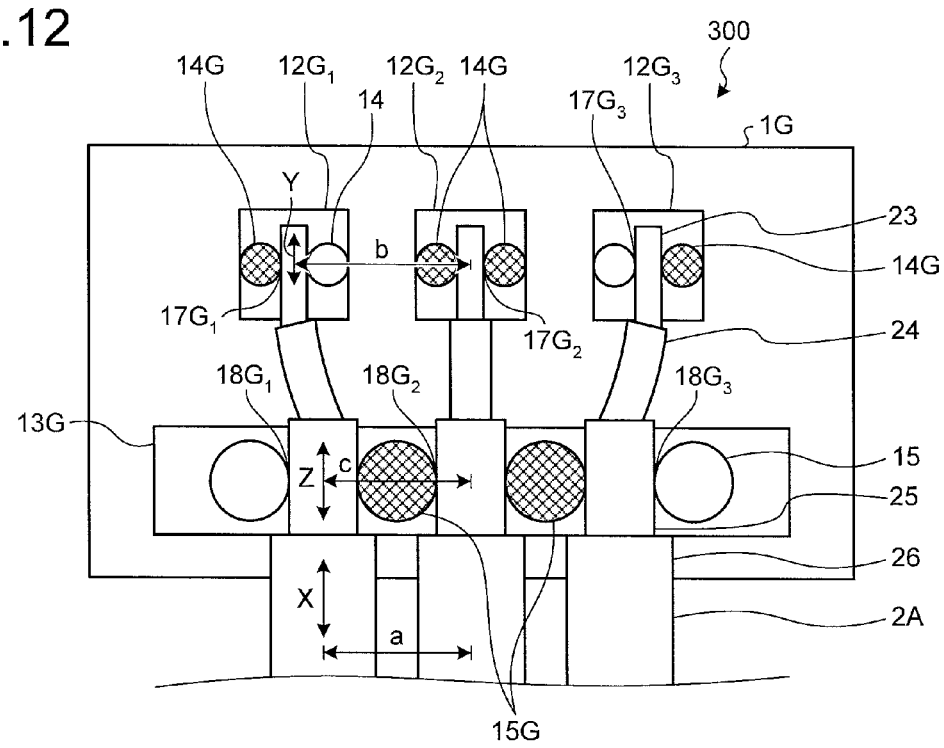
FIG. 12 schematically shows a cable connection structure according to a third embodiment.

FIG. 12 schematically shows a cable connection structure 300 according to the third embodiment.

A board 1G is provided with three center conducting body connecting electrodes 12$G_1$, 12$G_2$, and 12$G_3$ and an outer conducting body connecting electrode 13G. The first protruding part 14 and a first fusing protruding part 14G are formed on each of the center conducting body connecting electrodes 12$G_1$ and 12$G_3$. The first protruding part 14 is a fixed protruding part which is formed by a gold bump, a high-melting-point solder bump, or the like. The first fusing protruding part 14G is formed by a solder bump and the like and made of a material which fuses in soldering. In the description of the present invention, the solder bump means a bump formed by an eutectic solder of tin-lead system, melting point of which is 184 degrees C., a solder of tin-silver-copper system (of Sn-3.0Ag-0.5Cu composition, melting point of which is as high as 220 degrees C., for example) widely used as a lead-free solder, or a solder whose melting point or solidus temperature is lower than these solders. Two first fusing protruding parts 14G are formed on the center conducting body connecting electrode 12$G_2$. The first protruding part 14 and the first fusing protruding part 14G have the same diameter.

On the outer conducting body connecting electrode 13G, the second protruding part 15 and a second fusing protruding part 15G are formed. The second protruding part 15 is a fixed protruding part which is formed by a gold bump, a high-melting-point solder bump, or the like. The second fusing protruding part 15G is a fusing protruding part formed by a solder bump and the like. In the third embodiment, inner two protruding parts are the second fusing protruding parts 15G as the fusion protrusion part and outer two protruding parts are the second protruding parts 15 as the fixed protruding part. The second protruding part 15 and the second fusing protruding part 15G have the same diameter and formed at equally-spaced intervals on the outer conducting body connecting electrode 13G.

In the third embodiment, first groove parts 17$G_1$ to 17$G_3$ are formed so that the extending direction Y of the center conducting bodies 23 arranged in the first groove parts 17$G_1$ to 17$G_3$ is not aligned with the extending direction X of the coaxial cable 2A. The first groove parts 17$G_1$ to 17$G_3$ are formed so that the alignment pitch b of the center conducting bodies 23 becomes wider than the alignment pitch a of the coaxial cables 2A.

In the third embodiment, since the inner insulating body 24 is bent from the extending direction X of the coaxial cable 2A and connected to the board 1G so that the alignment pitch b of the center conducting bodies 23 becomes wider than the alignment pitch a of the coaxial cable 2A, a protruding part forming a wiring route is subjected to a stress. In the third embodiment, protruding parts which are subjected to the stress are formed by the fixed protruding parts (the first protruding part 14 and the second protruding part 15) and the other protruding parts are formed by the fusing protruding parts (the first fusing protruding part 14G and the second fusing protruding part 15G), so that a misalignment in position of the coaxial cable 2A can be prevented and a process of supplying a joint member for jointing the coaxial cable 2A onto the board 1G can be eliminated.

Besides, in the cable connection structure 300 according to the third embodiment, a degree of freedom of the layout in mounting the center conducting body 23 onto the board 1G can be improved by making a connection to the board 1G so that the extending direction Y of the center conducting body 23 of the coaxial cable 2A is not aligned with the extending direction X of the coaxial cable 2A, and an adverse effect caused by an interference between signals transmitted in respective coaxial cables 2A can be suppressed since the alignment pitch b of the center conducting bodies 23 is wider than the alignment pitch a of the coaxial cables 2A.

Figure 13:
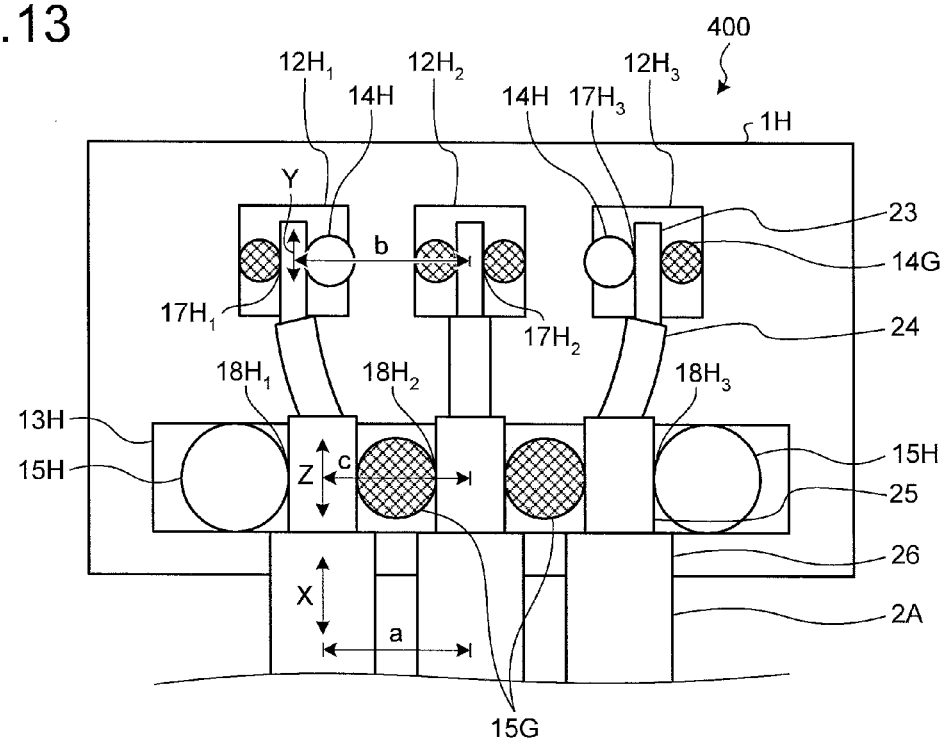
FIG. 13 schematically shows a cable connection structure according to a fourth embodiment.

A fourth embodiment of the present invention will be explained next. In a cable connection structure according to the fourth embodiment, protruding parts forming a groove part include the fixed protruding part and the fusing protruding part, and the fixed protruding part is formed in a size larger than the fusing protruding part. FIG. 13 schematically shows a cable connection structure 400 according to the fourth embodiment.

A board 1H is provided with three center conducting body connecting electrodes 12$H_1$, 12$H_2$, and 12$H_3$ and an outer conducting body connecting electrode 13H. A first protruding part 14H and the first fusing protruding part 14G are formed on each of the center conducting body connecting electrodes 12$H_1$ to 12$H_3$. The first protruding part 14H is a fixed protruding part which is formed by a gold bump, a high-melting-point solder bump, or the like. The first fusing protruding part 14G is a solder bump made of a material which fuses in soldering. Two first fusing protruding parts 14G are formed on the center conducting body connecting electrode 12$H_2$. The first protruding part 14H is configured to be a bump having a larger diameter than the first fusing protruding part 14G.

On the outer conducting body connecting electrode 13H, a second protruding part 15H and the second fusing protruding part 15G are formed. The second protruding part 15H is a fixed protruding part which is formed by a gold bump, a high-melting-point solder bump, or the like. The second fusing protruding part 15G is a fusing protruding part formed by a solder bump and the like. The second protruding part 15H is configured to be a bump having a larger diameter than the second fusing protruding part 15G. In the fourth embodiment, outer two protruding parts are the second protruding parts 15H as the fixed protruding part and inner two protruding parts are the second fusing protruding parts 15G as the fusing protruding part. The second protruding part 15H and the second fusing protruding part 15G are arranged on the outer conducting body connecting electrode 13G so that the alignment pitch c of the outer conducting bodies 25 is uniform.

In the fourth embodiment, first groove parts 17$H_1$ to 17$H_3$ are formed so that the extending direction Y of the center conducting bodies 23 arranged in the first groove parts 17$H_1$ to 17$H_3$ is not aligned with the extending direction X of the coaxial cable 2A, similarly to the third embodiment. The first groove parts 17$H_1$ to 17$H_3$ are formed so that the alignment pitch b of the center conducting bodies 23 becomes wider than the alignment pitch a of the coaxial cables 2A.

In the fourth embodiment, since the inner insulating body 24 is bent from the extending direction X of the coaxial cable 2A and connected to the board 1H so that the alignment pitch b of the center conducting bodies 23 becomes wider than the alignment pitch a of the coaxial cables 2A, a protruding part forming a wiring route is subjected to a stress. In the fourth embodiment, protruding parts which are subjected to the stress are formed by the fixed protruding parts (the first protruding part 14H and the second protruding part 15H) and the other protruding parts are formed by the fusing protruding parts (the first fusing protruding part 14G and the second fusing protruding part 15G), and additionally the first protruding part 14H and the second protruding part 15H as the fixed protruding part are formed to be larger in diameter than the first fusing protruding part 14G and the second fusing protruding part 15G as the fusing protruding part, respectively. This configuration allows preventing a misalignment in position of the coaxial cable 2A and eliminating a process of supplying a joint member for jointing the coaxial cable 2A onto the board 1H.

Besides, in the cable connection structure 400 according to the fourth embodiment, a degree of freedom of the layout in mounting the center conducting body 23 onto the board 1H can be improved by making a connection to the board 1H so that the extending direction Y of the center conducting body 23 of the coaxial cable 2A is not aligned with the extending direction X of the coaxial cable 2A, and an adverse effect caused by an interference between signals transmitted in respective coaxial cables 2A can be suppressed since the alignment pitch b of the center conducting bodies 23 is wider than the alignment pitch a of the coaxial cables 2A.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cable connection structure in which a coaxial cable including a core wire and a shielded wire and a board provided with a connecting electrode to which the coaxial cable is connected, wherein the board includes a core wire connecting electrode to which the core wire is connected, and a shielded wire connecting electrode to which the shielded wire is connected, the shielded wire connecting electrode includes at least two protruding parts constituting a first groove part in which the shielded wire is arranged, the protruding parts include a fixed protruding part which does not fuse in soldering the shielded wire onto the shielded wire connecting electrode, and an extending direction of the shielding wire arranged in the first groove part is not aligned with an extending direction of the coaxial cable.

2. The cable connection structure according to claim 1, wherein an extending direction of the core wire arranged in a second groove part is not aligned with an extending direction of the shielded wire arranged in the first groove part.

3. The cable connection structure according to claim 1, wherein the protruding parts include the fixed protruding part formed by one of a gold bump and a high-melting-point solder bump and a fusing protruding part which fuses in connecting the shielding wire to the shielding wire connecting electrode, and one of the protruding parts at a side of forming a route is formed by the fixed protruding part and the other one of the protruding parts is formed by the fusing protruding part in arranging the shielding wire in the first groove part.

4. The cable connection structure according to claim 3, wherein the fixed protruding part is larger than the fusing protruding part.

5. The cable connection structure according to claim 1, wherein the coaxial cable is an assembled cable in which a plurality of coaxial cables are assembled, and an alignment pitch of the first groove part is different from an alignment pitch of the assembled cable.

6. The cable connection structure according to claim 5, wherein a sum of a length of an exposed core wire, a length of an exposed inner insulating body, and a length of an exposed shielded wire is same in the plurality of respective coaxial cables.

7. A cable connection board to which a coaxial cable provided with a core wire and a shielded wire is connected, comprising:

a core wire connecting electrode which includes at least two first protruding parts and on which the core wire is arranged and connected in a first groove part formed by the first protruding parts; and a shielded wire connecting electrode which includes at least two second protruding parts and on which the shielded wire is arranged and connected in a second groove part formed by the second protruding parts, wherein the first protruding parts and the second protruding parts include a fixed protruding part and an extending direction of the core wire towards the first groove part is not aligned with an extending direction of the shielded wire towards the second groove part.

8. The cable connection board according to claim 7, wherein the fixed protruding part is one of a gold bump and a high-melting-point solder bump.

9. The cable connection board according to claim 7, wherein the first and the second protruding parts include a fixed protruding part formed by one of a gold bump and a high-melting-point solder bump and a fusing protruding part which fuses in connecting the core wire and the shielded wire respectively to the core wire connecting electrode and the shielded wire connecting electrode, and the first protruding part and the second protruding part locating at a side of forming a route are formed by the fixed protruding part and the other first protruding part and second protruding part are formed by the fusing protruding part in arranging the core wire in the first groove part and the shielded wire in the second groove part.

10. The cable connection board according to claim 9, wherein the fixed protruding part is larger than the fusing protruding part.

11. A cable connection board to which an assembled cable in which a plurality of cables are assembled is connected, comprising a plurality of connecting electrodes each including at least two protruding parts constituting a groove part in which a conducting body of the cable is arranged, wherein the protruding parts include a fixed protruding part formed by one of a gold bump and a high-melting-point solder bump and a fusing protruding part which fuses in connecting the conducting body to the connecting electrode, an alignment pitch of the groove part is different from an alignment pitch of the cable, and one of the protruding parts at a side of forming a route is formed by the fixed protruding part and the other one of the protruding parts is formed by the fusing protruding part in arranging the conducting body in the groove part.

* * * * *